US006390610B1

(12) United States Patent
Hawkins et al.

(10) Patent No.: US 6,390,610 B1
(45) Date of Patent: May 21, 2002

(54) ACTIVE COMPENSATION FOR MISDIRECTION OF DROPS IN AN INKJET PRINTHEAD USING ELECTRODEPOSITION

(75) Inventors: Gilbert A. Hawkins, Mendon; David L. Jeanmaire, Brockport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/696,541

(22) Filed: Oct. 25, 2000

(51) Int. Cl.[7] ..... B41J 2/105
(52) U.S. Cl. ..... 347/82
(58) Field of Search ..... 347/14, 19, 62, 347/73, 74, 75, 78, 77, 82

(56) References Cited

U.S. PATENT DOCUMENTS

| | | | | | |
|---|---|---|---|---|---|
| 3,877,036 | A | | 4/1975 | Loeffler et al. | 347/77 |
| 4,238,804 | A | | 12/1980 | Warren | 347/81 |
| 4,364,057 | A | | 12/1982 | Ebi et al. | 347/81 |
| 4,638,337 | A | * | 1/1987 | Torpey et al. | 347/65 |
| 5,185,615 | A | | 2/1993 | Koitabashi et al. | 347/35 |
| 5,250,962 | A | | 10/1993 | Fisher et al. | 347/32 |
| 5,592,202 | A | | 1/1997 | Erickson | 347/37 |
| 5,653,901 | A | * | 8/1997 | Yoshimura | 347/45 |
| 5,963,235 | A | * | 10/1999 | Chwalek et al. | 347/82 |
| 6,079,821 | A | | 6/2000 | Chwalek et al. | 347/82 |

* cited by examiner

*Primary Examiner*—John Barlow
*Assistant Examiner*—Juanita Stephens
(74) *Attorney, Agent, or Firm*—Norman Rushefsky

(57) ABSTRACT

For an inkjet printhead (10) having at least one nozzle (24) with heater elements **(28*a*, 28*b*) predisposed to direct the flow of ink drops (37) through the nozzle (24), a system and method of compensating for the effects of defects in the inkjet printhead (10) to permit compensation in the direction of ink drops (37) ejected from the nozzle (24). A thickness is then added to one or more heating elements (28*a*, 28*b*) of the inkjet printhead (10), such thickness calculated to compensate for the misdirection. The heater elements (28*a*, 28*b*) are immersed in a electroplating solution (42) and a voltage differential (40) applied to cause the electroplating solution (42) to form a electroplated coating (44) which acts to compensate for a misdirection of ink stream flow (36) out through at least one of the nozzles (24)**.

28 Claims, 9 Drawing Sheets

ACTIVE COMPENSATION FOR MISDIRECTION OF DROPS IN AN INKJET PRINTHEAD USING ELECTRODEPOSITION

CROSS-REFERENCED TO RELATED APPLICATION

The application is commonly assigned and is related to:

1. U.S. patent application Ser. No. 09/696,536 entitled "Active Compensation for Changes in the Direction of Drop Ejection in an Inkjet Printhead, "by Gilbert A. Hawkins et al., filed Oct. 25, 2000 and
2. U.S. patent application Ser. No. 09/696,680 entitled "Active Compensation For Changes in the Direction of Drop Ejection in an Inkjet Printhead Having Orifice Restricting Member," by Gilbert A. Hawkins et al., filed Oct. 25, 2000.

FIELD OF THE INVENTION

This invention relates in general to inkjet printheads and, more specifically, to control in the directionality of ink drops ejected from a printhead in order to improve image quality. More particularly, the invention relates to a method of compensating for defects in an inkjet printhead having at least one nozzle to correct misdirection of ink drops ejected from the nozzle.

BACKGROUND OF THE INVENTION

Without limiting the scope of the invention, its background is described in connection with inkjet printers, as an example.

Modern color printing relies heavily on inkjet printing techniques. The term "inkjet" as utilized herein is intended to include all drop-on-demand or continuous inkjet printer systems including, but not limited to, thermal inkjet, piezoelectric, and continuous, which are well known in the printing industry. Essentially, an inkjet printer produces images on a receiver medium, such as paper, by ejecting ink droplets onto the receiver medium in an image-wise fashion. The advantages of non-impact, low-noise, low-energy use, and low cost operations, in addition to the capability of the printer to print on plain paper, are largely responsible for the wide acceptance of inkjet printers in the marketplace.

The printhead is the device that is most commonly used to direct the ink droplets onto the receiver medium. A printhead typically includes an ink reservoir and channels, which carry the ink from the reservoir to one or more nozzles. Typically, sophisticated printhead systems utilize multiple nozzles for applications such as high-speed continuous inkjet printer systems, as an example. Continuous inkjet printhead device types include electrostatically controlled printheads and thermally steered printheads. Both printhead types are named according to the means used to steer ink droplets ejected from nozzle openings.

It is well known in the art of inkjet printing that image quality suffers from a failure to accurately control the direction from which ink drops exit the printhead. Variations in the direction of ink drops ejected from a given nozzle from a desired direction of ejection (usually perpendicular to the printhead surface) can occur due to changes in the nozzle during operation, as a result of manufacturing defects present before operation, or both. In most instances, repairs are too difficult and costly, resulting in scrapped parts and decreased manufacturing yields. Accordingly, a cost effective way of increasing printhead lifetimes and printhead production yields would be advantageous.

For any given nozzle, the direction of the exiting ink drop stream is controlled by the physical characteristics of the nozzle. Where misdirection occurs, the ink drops can produce printing artifacts such as random placement errors between subsequent drops from a single nozzle or placement errors of drops from one nozzle with respect to those from another nozzle. Variations in the direction of ink drops ejected from a given nozzle may occur over a variety of time scales. For example, in Bubble Jet printheads, made by Canon Company, rapid variations may occur when bubbles nucleate randomly on the surfaces of heaters, causing random variations in the velocity and direction of ejected ink drops from each nozzle. Variations in the direction of ejected ink drops may also be caused by sources external to the inkjet printhead such as, for example, vibrations of the inkjet printer. It is difficult or impossible to correct such random variations in the direction of ejected ink drops, which typically change rapidly with time.

In other cases, factors causing deviation of the direction of ejected ink drops from a desired direction can occur slowly over a long period of time. Such slowly changing variations may arise, for example, from gradual changes in the material properties of the nozzle, such as changes in the stress of the materials comprising the nozzle or surrounding the nozzle openings, from changes in the resistance of heater materials during operation, or from wear of nozzle materials during operation.

In still other cases, factors causing deviation of the direction of ejected ink drops from a desired direction can be essentially permanent. Deviations caused by manufacturing defects in nozzles, for example defects which alter or vary the shape of the nozzle openings, are essentially permanent. Permanent deviations may also arise after a period of time of operation of a nozzle. For example, a piece of material may become permanently chipped away from a portion of a nozzle after a period of time of operation, or a piece of material may lodge permanently within a nozzle during operation.

Thus, it is desirable to compensate for slowly changing variations in the directionality of ejected ink drops. For slowly changing variations, compensation may be needed from time to time during operation. It is also desirable to compensate for permanent changes in the directionality of ejected ink drops in order to improve image quality and increase manufacturing yield. Compensation cannot be applied before operation of the nozzles, since it is generally not possible to predict the direction and magnitude of deviations in the direction of ejected drops for a particular nozzle, which occur after operation. Compensation applied after or during operation of nozzles is herein referred to as active compensation.

Substantial effort has been directed toward active compensation for slowly changing variations in the direction of drop ejection for drop on demand printers, as discussed and illustrated, for example, in U.S. Pat. No. 4,238,804, assigned to Xerox Corporation, and U.S. Pat. No. 3,877,036, assigned to IBM, which teach measuring the position of ejected ink drops and compensating for variations from the ideal direction by electrostatic means. While such electrostatic deflection can be used to direct ink in a desired direction, as is well known in the art, electrostatic deflection in these cases adds mechanical complexity. Also, correction techniques of this type are largely ineffective in cases where large variations in the direction of ejected ink drops occur.

U.S. Pat. No. 5,592,202, assigned to Laser Master Corporation, teaches an electronic means to correct inaccuracies in ink drop placement by advancing or retarding the time of a drop-on-demand actuation pulse. However, this method does not correct variations in both of the directions of ink drop ejection in a plane perpendicular to the direction of drop ejection, as it is more suited to adjusting ink drop placement only in the scan direction of the printhead. Moreover, not all printhead circuits can be easily adapted to control the firing times of individual ink drops, since the firing pulses may be derived from a common clock.

U.S. Pat. No. 5,250,962, assigned to Xerox Corporation, teaches the application of a moveable vacuum priming station that can access groups of nozzles to remove entrained air in one or more nozzles. Although entrained air is known in the art to cause variations in the direction of ink drop ejection, it is only one of many mechanisms causing variations. Also, entrained air principally refers to failure of the ink to fill the printhead, not to a change in the head itself. Removal of trapped air serves to restore the nozzle to its original condition, but does not alter the physical characteristics of the nozzle.

Other prior art techniques for achieving compensation include the selection of one nozzle among a plurality of redundant nozzles for printing a particular imaging pixel, the preferred nozzle having favorable ink drop ejection characteristics. However, redundancy selection techniques of this type are complex in nature and require substantial real estate space on the printhead form factor to implement. Such methods also increase cost and/or reduce productivity.

In the case of continuous inkjet printheads using electrostatic steering of drops, as in the current generation of commercialized continuous inkjet printheads, for example those manufactured by Scitex Corp., compensation for variations in the direction of ejected ink drops from an ideal direction can be accomplished by electrostatic means; and in this case, additional mechanical complexity is not required, since the means of printing itself is based on electrostatic deflection and the required hardware is already in place. Printheads of this type produce electrically charged ink drops, which are deflected using a charged electrode at each nozzle. The electrode voltage is set to one of two discreet values (for example, either 100 volts or 0 volts) each time a drop is ejected, causing drops to be deflected either in a printing direction (for example, in the case the voltage is 100 volts), or into a gutter (for example, in the case the voltage is 0). To correct for slow or permanent deviations of the direction of ejected drops from a particular nozzle, the voltage corresponding to printing at that nozzle might be set, for example, to 110 volts. The use of electro-static techniques such as these, however, requires additional voltage control hardware.

In the case of continuous inkjet printheads using thermal steering of drops, an electrode apparatus is not already in place, and other means of correction are desired to correct for the effects of slow variations in direction of ink drop ejection, as well as for permanent manufacturing defects.

Accordingly, a need exists for a cost effective method of correcting defects in inkjet printheads to permit compensation in the direction of ink drops ejected from the nozzles. A means of increasing manufacturing yields by permitting active compensation for ink drop ejection misdirection from a nozzle would provide numerous advantages.

SUMMARY OF THE INVENTION

The present invention provides a method of correcting misdirection of ink drops ejected from the nozzles of an inkjet printhead which occur from time to time after the manufacture of the printhead and/or during operation of a printhead having at least one nozzle with heater elements to direct ink drops ejected from the nozzle. With the present invention, thermally steered printheads that would normally be discarded due to defects that cause ink drop misdirection can be repaired rather than discarded, and thermally steered printheads that fail due to the behavior of one or more nozzles which, after operation, eject ink drops in a direction which is not the desired ink drop ejection direction can be repaired without removal from the printer.

Accordingly, disclosed in one embodiment is a method of compensating for the effects of defects in an inkjet printhead to permit control in the direction of ink drops ejected from a nozzle of the printhead. Initially, the printhead is tested to determine its ink stream directionality onto a receiver medium, such as paper. Thereby, the amount of misdirection from a nozzle of an inkjet printhead is thus quantified, as is well known in the art.

The method comprises the steps of immersing the heater elements surrounding the nozzle in an electroplating solution and applying a voltage differential measured with respect to the electroplating solution to at least one of the heater elements in order to add electroplated material to that heater element, or to remove electroplated material from a heater element to which electroplated material had been previously added. In one embodiment, an ink drop deviation angle from the desired vertical direction for ink drops exiting one of the nozzles is calculated and a voltage differential is applied to one of the heater elements in order to cause a deflection of the ink drop stream in a desired direction. The electroplated material acts to compensate for any misdirection of ink drops out of the printhead nozzles. Since the heater elements may include both heaters and heater electrodes located at numerous locations around the nozzle, electroplated material can be applied at numerous locations around the nozzle.

For example, if ink drop deviation to the left of the desired vertical direction is desired, a voltage differential can be applied to a right heater electrode of the nozzle in order to deflect the ink drop stream to the left; whereas, if ink drop deviation to the right of the desired vertical direction is desired, a voltage differential can be applied to the left heater of the nozzle.

The step of applying the voltage differential can be performed by applying a voltage differential to a heater element having a value for which electroplating occurs in order to establish an increased thickness of electroplated coating across the area spanned by the heater element. Alternatively, the step of applying the voltage differential can be performed by applying a voltage having a value for which electroetching occurs in order to establish a reduced thickness of electroplated coating across the area spanned by a heater element having been previously subjected to electroplating. Electroetching of material deposited by means other than electrodeposition is also possible. Additionally, the time of exposure to the voltage differential can be varied in order to vary the final characteristics of the electroplated coating. The electroplated coating acts to compensate for any misdirection of ink drops out of the printhead nozzles.

According to another embodiment, disclosed is an inkjet printhead with integral compensation for misdirection of ink drops ejected through at least one nozzle of the printhead. The inkjet printhead comprises a nozzle cavity adapted for facilitating the flow of ink from an ink reservoir. The inkjet printhead also comprises a membrane predisposed about the nozzle cavity to create a resistive barrier against ink flow.

The membrane includes a nozzle opening through which ink drops are ejected.

In accordance with yet another embodiment, the inkjet printhead further comprises heater elements predisposed to direct the flow of ink drops through the nozzle opening. The heater elements comprise heater electrodes and heaters. The heaters include a right heater and a left heater, which are predisposed about the nozzle opening. In addition, the heater electrodes further include one or more lower left electrodes and one or more lower right electrodes. The heater electrodes are electrically coupled to the heaters so as to have the same electrical voltage as the heater and predisposed about the nozzle opening. As such, the heater electrodes and heaters are separated by the membrane.

Technical advantages of the present invention include a cost effective method of compensating for the effects of defects in inkjet printheads that would otherwise result in misdirection of ink drops ejected from the nozzles. As such, printing artifacts caused by irregularities in the ink drops landing onto a receiver medium are eliminated.

Other technical advantages include increases in the useable life of printheads during operation which otherwise would fail due to changes in the direction of ink drop ejection from one or more nozzles from time to time during operation of the printheads and increases in manufacturing yields as printheads that would be typically discarded can be repaired and used.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description unless otherwise indicated.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. These specific embodiments discussed herein are merely illustrative of specific ways to make and use the invention, and do not delimit the scope or application of the invention.

Figure 1:
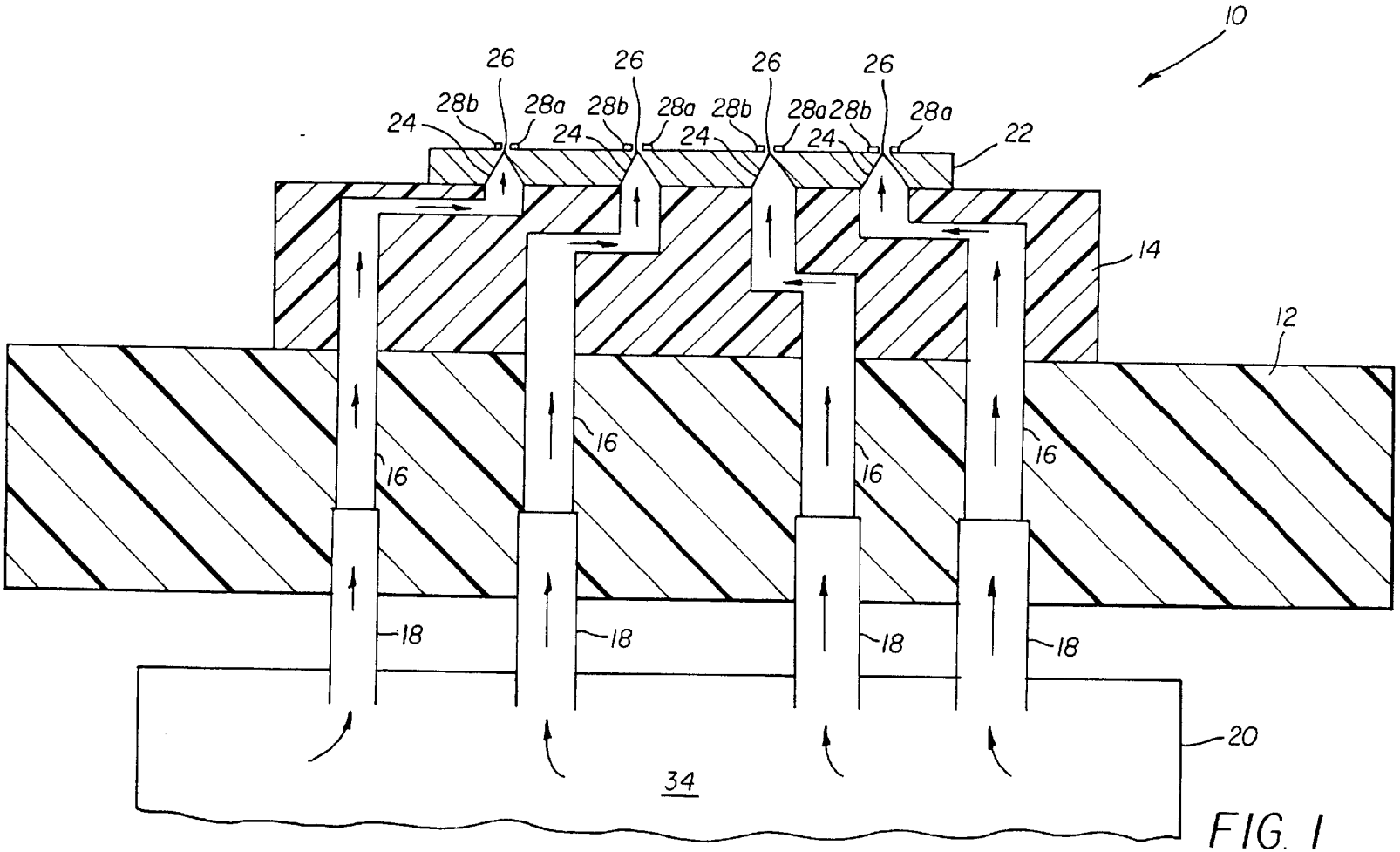
FIG. 1 is a diagram illustrating an inkjet printhead in which a preferred embodiment of the present invention may be implemented.

Referring to FIG. 1, therein is shown an inkjet printhead, denoted generally as 10, to which the active compensation techniques of the present invention can be applied. Inkjet printhead 10 is a device that is most commonly used to direct ink droplets or "drops" onto a receiver medium, such as paper. The ink drops exit rapidly enough so as to form an ink drop stream. As such, the terms "ink drops", "ink droplets", and "ink" will be used interchangeably throughout.

Inkjet printhead 10 includes an ink reservoir 20, fluid-flow channels 18 and inlet/outlet tubes 16 which carry the ink 34 from the reservoir 20 to one or more nozzles 24. Inkjet printhead 10 also comprises a mounting block 12, a gasket manifold 14, and a substrate 22 which internally define the fluid flow channels 18, providing an ink stream route from the ink reservoir 20 to one or more nozzles 24. Those skilled in the art will appreciate that the figures referred to herein are not drawn to scale and have been enlarged in order to illustrate the major aspects of the inkjet printhead 10. A scaled drawing would not show the fine detail necessary to portray and understand the present invention.

Some inkjet printheads are made using thermally steered ink drop technology. As such, thermally steered inkjet printheads utilize thermal means to steer a continuous stream of ink drops ejected from each of a plurality of nozzle openings 26 in the inkjet printhead 10. Each of the nozzle openings 26 may be referred to as an "orifice" or a "bore", and these terms will be interchangeable throughout. Inkjet printhead 10 further includes a plurality of right heaters 28*a* and left heaters 28*b*. The heaters 28*a*, 28*b* are predisposed about corresponding nozzle openings 26 and adapted to direct the flow of ink drops 34 through the nozzle openings 26. For simplicity, the terms "heater" and "heaters," "opening and "openings" will be used interchangeably to refer to the singular and plural form of the corresponding part.

Figure 2:
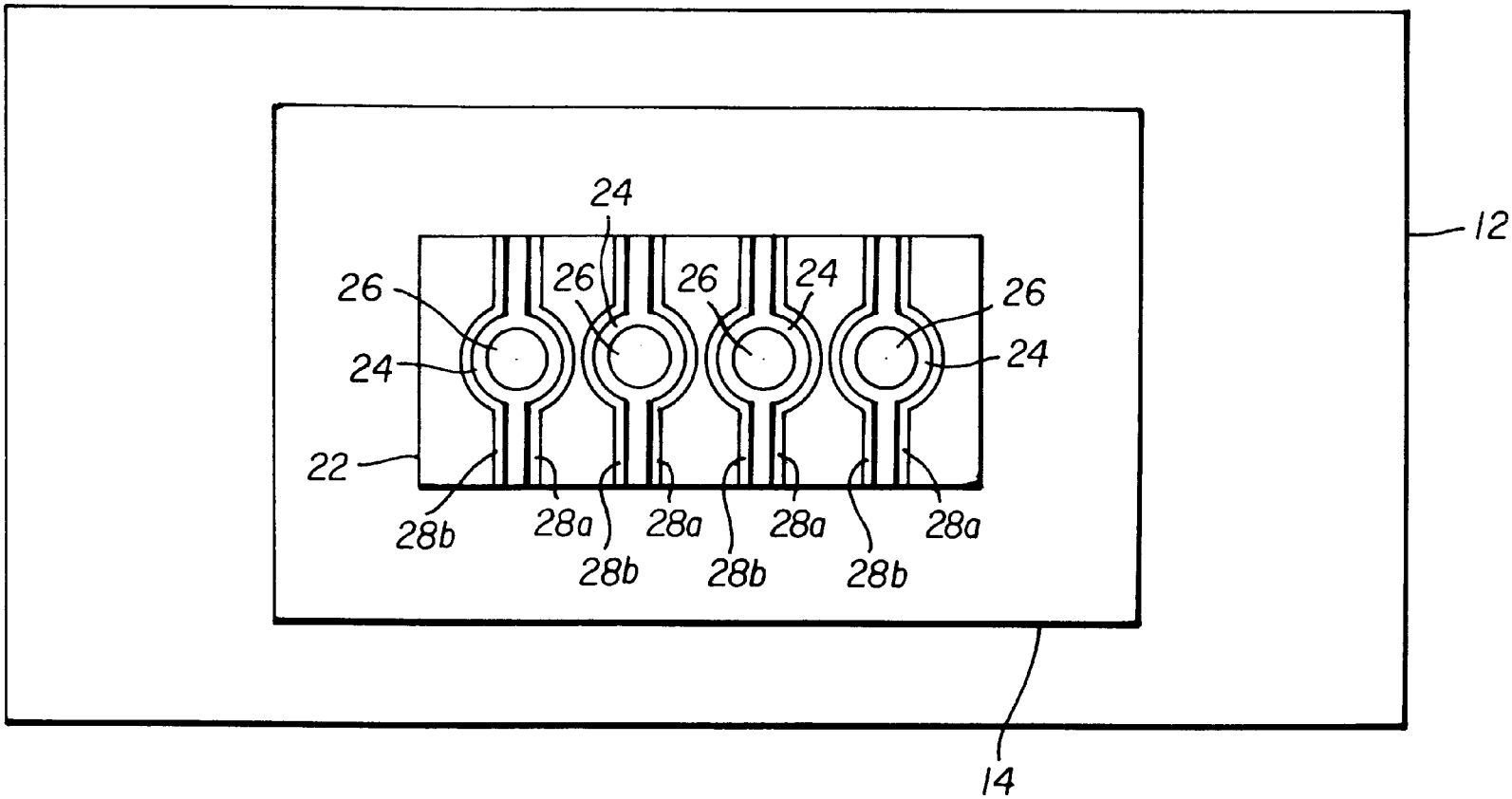
FIG. 2 depicts a top view of the inkjet printhead shown in FIG. 1.

FIG. 2 is a top view of a thermally steered inkjet printhead, such as printhead 10. As previously discussed, substrate 22 is attached to the gasket manifold 14 which, in turn, is bonded to the mounting block 12 in order to form the sub-assembly of inkjet printhead 10.

The mounting block 12 and the gasket manifold 14 together form a delivery system via fluid flow channels 18 which are defined within. The fluid flow channels 18 provide a route for the ink stream 36 to exit the nozzles 24 through their respective nozzle openings 26. Predisposed about the nozzle openings 26 are heaters 28*a*, 28*b*, which are used to direct the flow of ink drops 36 through the nozzle openings 26 via thermal deflection. The heaters 28*a*, 28*b* are arranged in a split-ring fashion about the nozzle openings 26. That is, the heaters 28*a*, 28*b* comprise a right half and a left half, or a right heater 28*a* and a left heater 28*b,* respectively. Such arrangement allows for thermal deflection of the ink stream 36 exiting the nozzle openings 26 onto a receiver medium. Therefore, if an ink stream 36 directed to the right is desired, the left heater 28*b* is heated, causing the ink stream 36 to bend to the right. If, however, an ink stream 36 directed to the left is desired, then the right heater 28*a* is heated, causing the ink stream 36 to bend to the left.

Figure 3A:
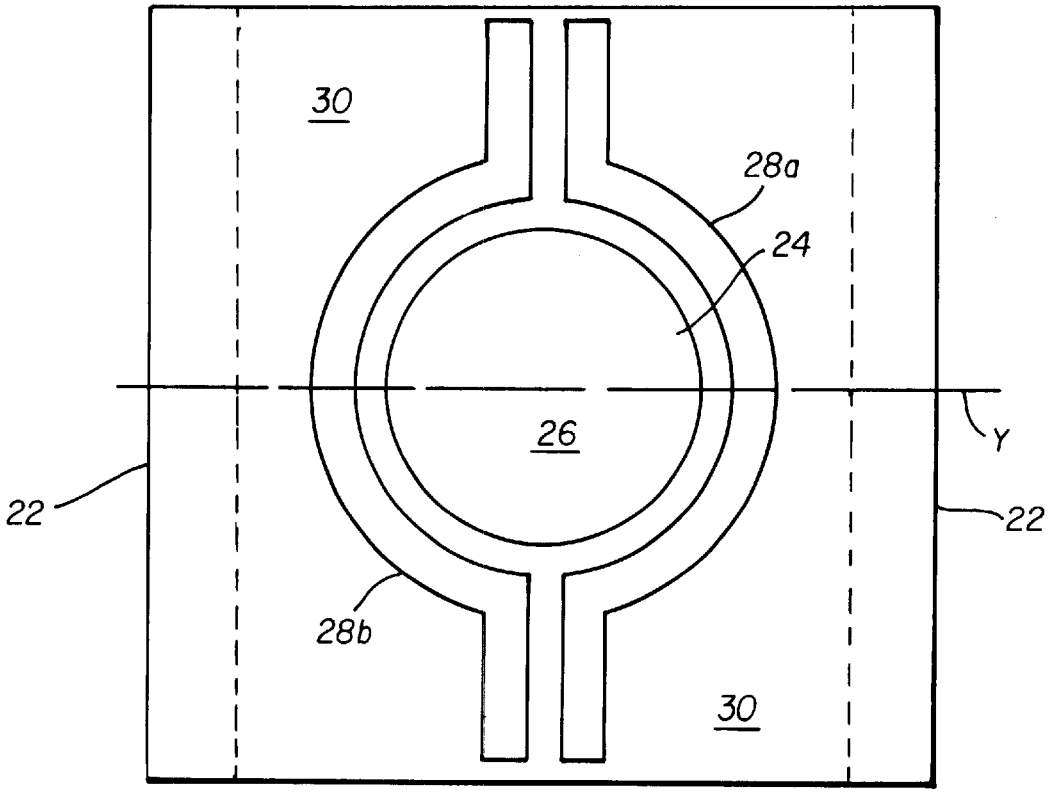
FIG. 3*a* shows a close-up view of a nozzle of the inkjet printhead of FIG. 1 and the heater elements about the nozzle opening.
Figure 3B:
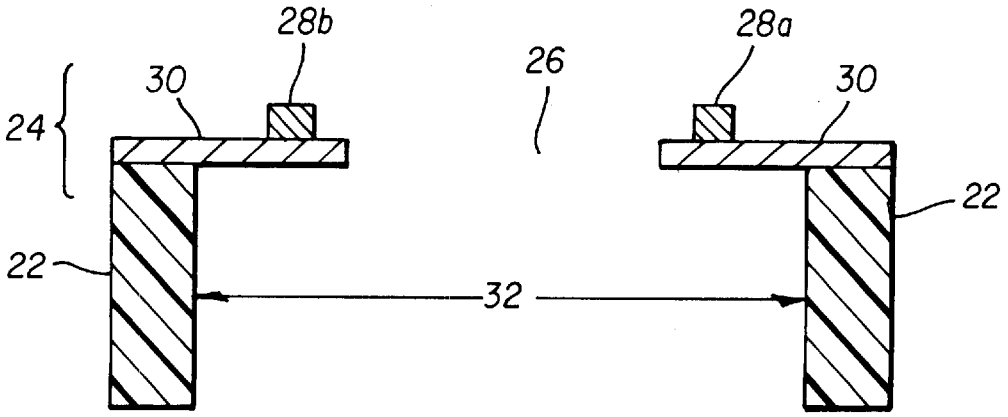
FIGS. 3*b* and 3*c* are cross sections of the nozzle of FIG. 3*a*.
Figure 3C:
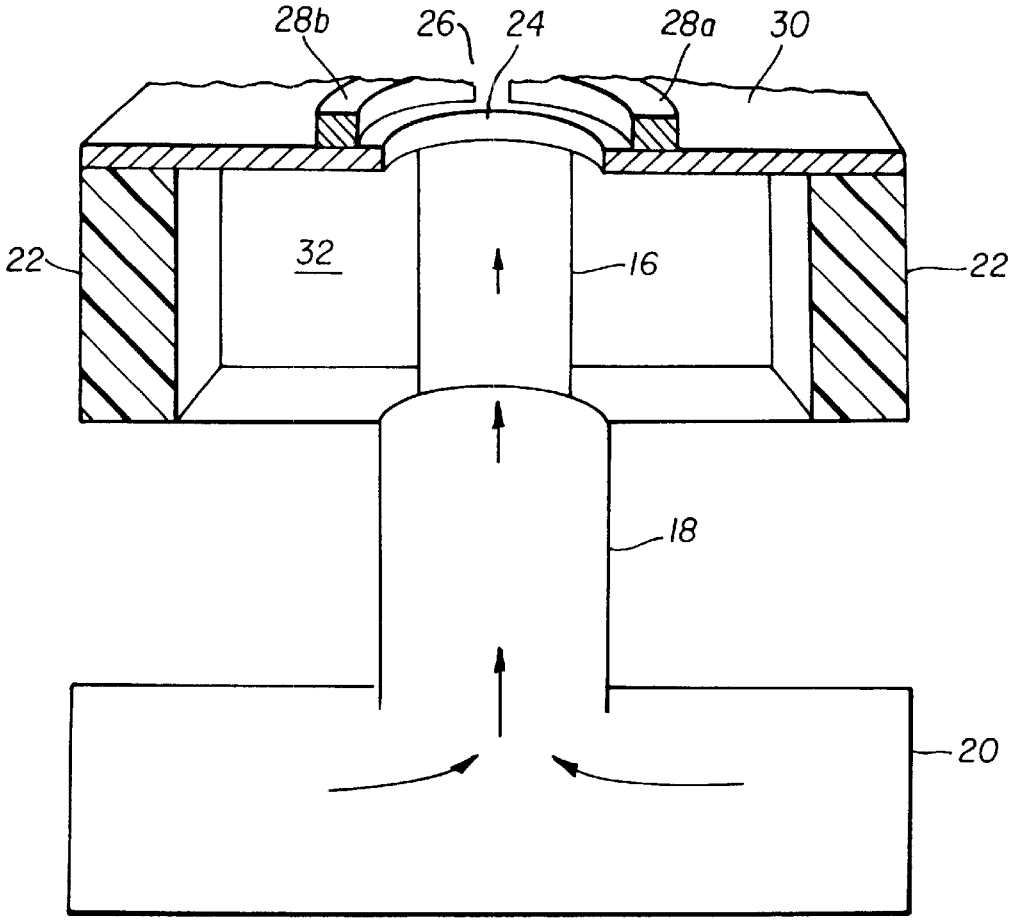

FIG. 3*a* is a top view of a single nozzle 24 within an inkjet printhead, such as printhead 10, showing the configuration of heaters 28*a,* 28*b* about a single nozzle opening 26. FIGS. 3*b* and 3*c* are cross-sections of the printhead of FIG. 3*a* taken about axis Y. As shown, a nozzle 24 comprises a nozzle cavity 32 for facilitating the flow of ink 34. A membrane 30 covering the nozzle cavity 32 is provided, the membrane having a bore 26 through which ink 34 is ejected. Two or more heaters 28*a,* 28*b* are supported by the membrane 30. In operation, ink 34 from the nozzle cavity 32 is ejected through the bore 26 and travels in an ink stream 36 as shown in FIG. 4*a*.

At a distance removed from the printhead 10, the ink stream 36 breaks up into ink drops 37 travelling in the same direction as the ink stream 36. Heat pulses applied to one or more heaters 28 cause the ink stream 36 and the ink drops 37 to be directed in a printing direction or in a non-printing direction. Typically, ink is recycled from the non-printing direction using a gutter assembly (not shown) that directs the ink to a recycling unit (not shown). Thus, ink 34 travels from the ink reservoir 20 through the fluid flow channels 18 to the inlet/outlet tubes 16 in order to exit the nozzle opening 26, as shown in FIG. 3*c*.

For printheads having many nozzles, each similar to the nozzle 24 shown in FIGS. 3*a* (top view) and 3*b* (cross-section of FIG. 3*a*), a percentage of the nozzles (typically 1–5%) eject ink drops 37 in a direction that creates undesirable printing artifacts. The ink stream 36 of FIG. 4*a* flowing through nozzle 24 needs no correction. That is, the ink stream 36 is ejected out of nozzle 24 in the desired vertical direction 38, perpendicular to the top surface of the inkjet printhead 10. The desired direction is usually normal to the substrate 22 on which the inkjet printhead 10 is built.

Figure 4B:
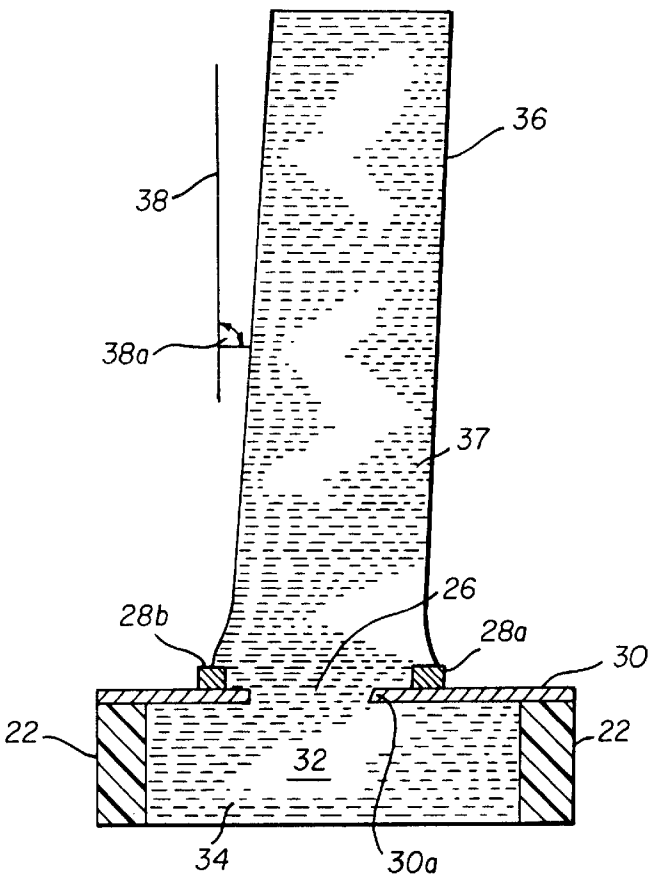
FIG. 4*b* shows the ejection of an ink stream for the case of a nozzle needing correction.
Figure 4A:
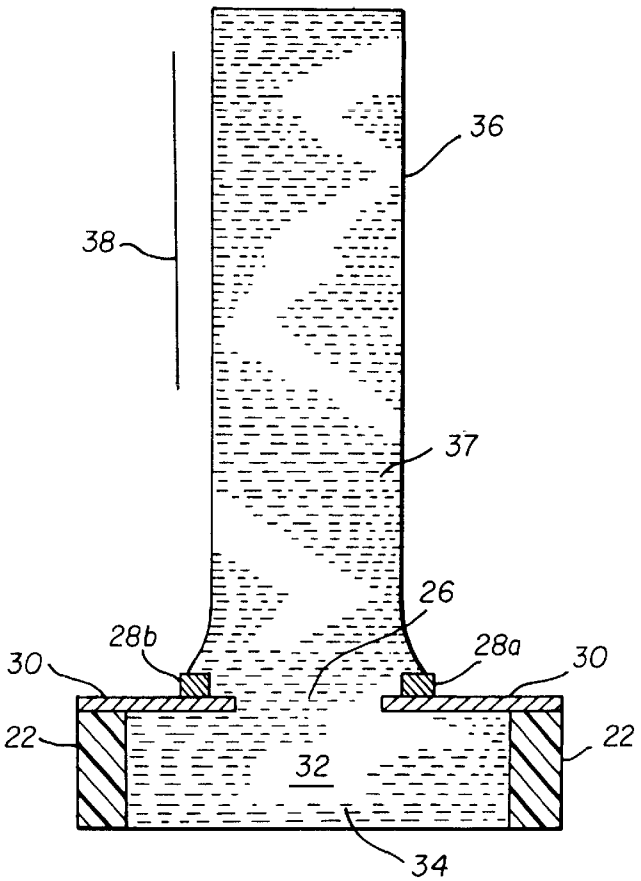
FIG. 4*a* shows the ejection of an ink stream for the case of a nozzle needing no correction.

In FIG. 4*b,* a defect 30*a,* as shown on the right side of the membrane 30, causes the ejected ink stream 36 to deviate at an angle 38*a* from the desired vertical direction 38. This results in ink stream 36 being misdirected as it exits nozzle 24.

It is desired, in accordance with the present invention, to provide a means of compensating for such misdirection. To this end, device and hardware means are provided for "at times" adjusting the direction of ink drops 37 ejected from ejection orifices 26. "At times" means that the direction may be adjusted immediately after manufacture, and may also be adjusted occasionally thereafter, typically weekly or even hourly, and even frequently enough as to be adjusted during a printing cycle. Such a means may be referred to as an adjustment operation. Preferably, the heaters 28*a* and 28*b* are made from an electrical conductor, such as Titanium, which is not covered with a thick insulating material. This geometry is particularly useful for the case of an inkjet printhead 10 operating with solvent-based ink 34 and non-ionic dyes.

With reference now to FIGS. 5*a*–5*e,* heaters, heating elements, heater electrodes and/or other similar electrically conductive ink steering components will be referred to generally as heater elements since numerous configurations of thermal steering devices may be employed. For an inkjet printhead 10 having at least one nozzle 24 with heater elements 54*a,* 54*b* predisposed to direct the flow of ink drops 37 through the nozzle 24, a method of compensating for the effect of defects (e.g., membrane defect 30*a,* for example) in the printhead 10 to permit compensation for misdirection of ink drops 37 ejected from the nozzle 24 is desired.

Figure 5A:
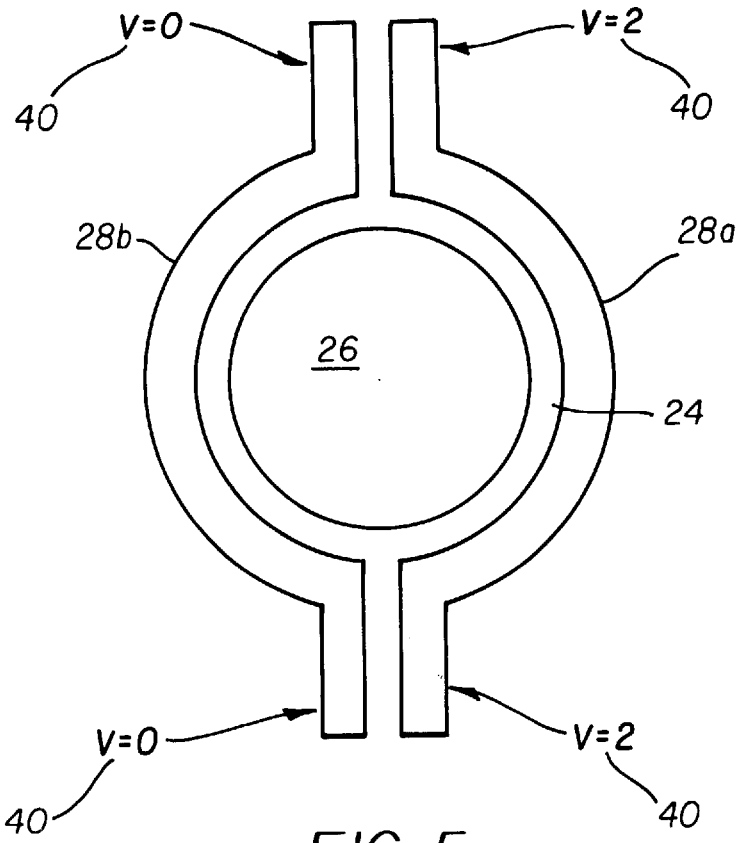
FIG. 5*a* depicts a nozzle of the printhead of FIG. 1 having heater elements with an applied voltage differential.
Figure 5B:
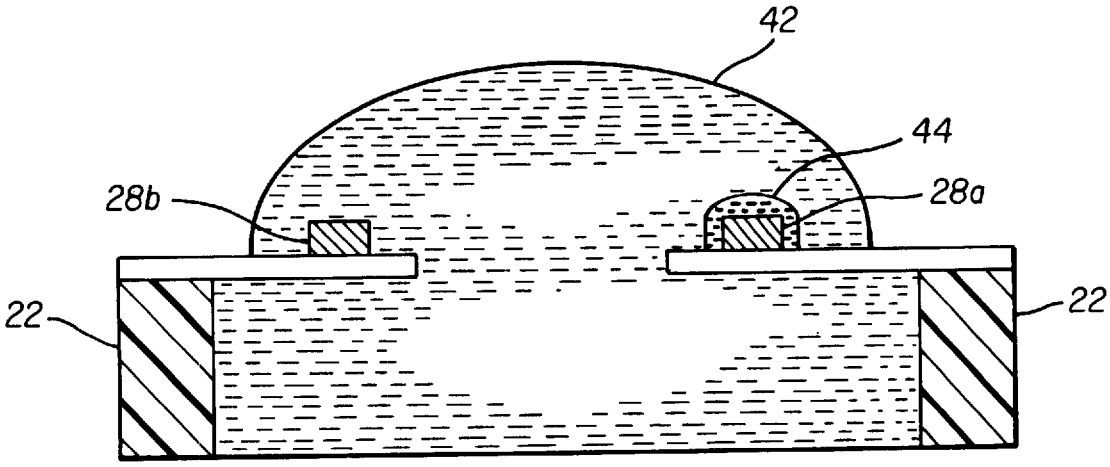
FIG. 5*b* illustrates the step of immersing a heater in an electroplating solution, in accordance with one embodiment of the present invention.
Figure 5C:
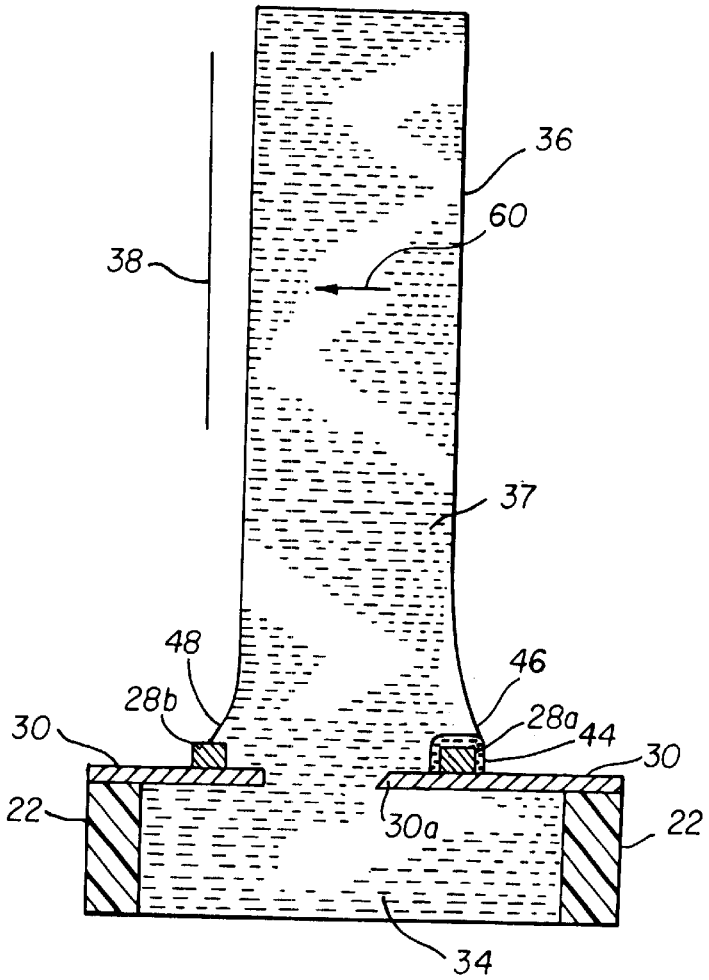
FIG. 5*c* shows the ejection of an ink stream for a corrected nozzle, in accordance with one embodiment of the present invention.

FIGS. 5*a*–5*c* illustrate a method of correcting ink stream misdirection due to the membrane defect 30*a* as shown in FIG. 4*b,* according to one embodiment. Initially, each inkjet printhead is tested to determine if it needs compensation. This allows a determination as to the amount of misdirection of the ink drops 37 ejected from a nozzle 24 of the inkjet printhead 10 caused by manufacturing defects, such as manufacturing defect 30*a*. The amount of misdirection for the ink drops 37 ejected from the nozzle 24 assists in determining how much correction to apply in order to avoid discarding the printhead. The values of the corrections required for various defects may be stored in a look-up table, which is a part of the printer.

In one embodiment, a measurement of deviation angle 38*a,* as measured from the desired vertical direction 38, is completed, as illustrated in FIG. 4*b*. Here, the error may be due to a defect in the manufacturing process (i.e., membrane manufacturing defect 30*a*) or may be due to a defect caused by a slow change in the geometry of the membrane during printhead operation. In this case, an increase in the spatial extent of the membrane is shown, due, for example, to a foreign particle lodged on the membrane. The defect is one that introduces an asymmetry between the left and the right side of the nozzle opening 26, in this case due to one of the heaters 28*a,* 28*b* being spaced more closely on the left than on the right.

Next, the nozzle cavity 32 is filled with an electroplating solution 42, as shown in FIG. 5*b,* which is allowed to spill over to cover both heaters 28*a,* 28*b*. A coating, or electroplated coating 44, may then be formed by applying a voltage differential between heater 28*a* and the electroplating solution 42, as is well known in the art of electroplating. The electroplated coating 44 produced by application of a voltage differential in this manner is illustrated in FIG. 5*b*.

The plating solution, or electroplating solution 42, may include, but is not restricted to, a metallic electroplating solution containing nickel, copper, aluminum or steel, for example. The solution may additionally contain organic material, such as fluorinated hydrocarbons, which can be incorporated in the electroplated coating. As is well known in the art of electroplating, this technique can cause an electroplated coating 44 to be formed by electrolytic deposition on the electrical conductor to which the voltage differential is applied. The electroplated coating 44 thickness may be made larger or smaller by varying the time of electrodeposition (time of exposure to electroplating solution 42) or by varying the voltage differential between heater 28*a* and electroplating solution 42. In this manner, the thickness of an electroplated coating 44 previously applied to a heater 28 may be increased or reduced. The electroplated coating 44 may have an electrical resistance higher than that of the heater 28*a* or may alternatively have a resistance lower than that of the heater 28*a,* depending upon the material and the conditions of deposition.

In accordance with the object of the present invention, electroplated coating 44 adds a physical characteristic to printhead 10 such that it compensates for any misdirection of the ink stream 36 exiting nozzle 24, (shown in FIG. 5*c* in comparison to FIG. 4*b*) due to defects in the printhead, such as defect 30*a*. As is well known in the art of fluidics, the presence of an electroplated coating 44 generally alters the meniscus contact angle between the ink stream 36 at the top of the electroplated coating 44 on heater 28*a* in comparison with the contact angle between the ink stream 36 and heater 28*a* in the absence of the electroplated coating 44, and thereby a net force is exerted on the ink stream 36. The additional height of the electroplated coating 44 on heater 28*a* in comparison to heater 28*b* on the opposite side of the nozzle 24 causes an imbalance of force on the ink stream 36 flowing through the nozzle 24 which also results in compensation of the direction of ink drop ejection. For example, in FIG. 5*c,* the right heater 28*a* has received an electroplated coating 44, resulting in active compensation of ink stream 36 in the direction of first arrow 60 to the left. The same technique could be applied to left heater 28*b* to achieve compensation in an opposite direction.

Figure 5D:
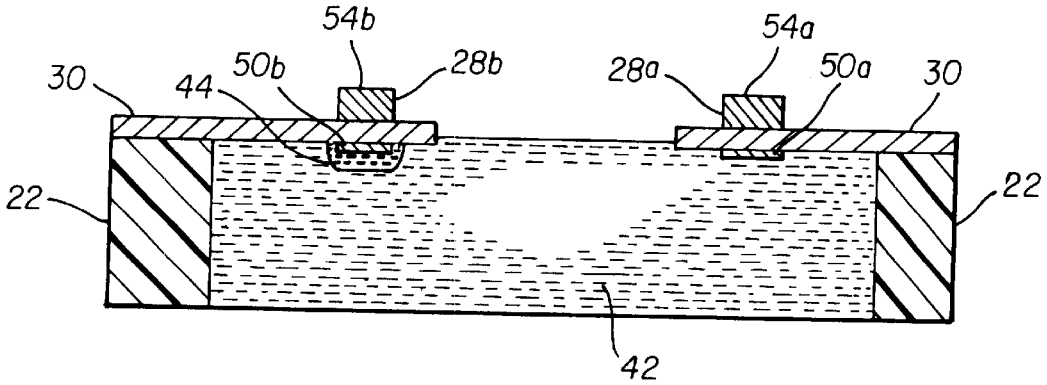
FIG. 5*d* illustrates the step of immersing a heater electrode in an electroplating solution, in accordance with one embodiment of the present invention.

In another embodiment of the present invention, shown in FIG. 5*d,* a set of corresponding heater electrodes 50*a,* 50*b* on the lower side of the membrane 30 are shown, in addition to the heaters 28*a,* 28*b*. In one preferred embodiment, heater electrodes 50*a,* 50*b* each underlie heaters 28*a,* 28*b* respectively, are disposed on the opposite side of the membrane 30, and are in electrical contact with their respective overlying heater 28. The voltage of heater electrodes 50*a,* 50*b* may therefore be controlled by controlling the voltage 40 applied to the heaters 28*a,* 28*b,* for which means is naturally provided in the design of a thermally steered printhead, such as printhead 10. Alternatively, in another preferred embodiment, the voltage of heater electrodes 50*a,* 50*b* may be otherwise controlled, for example by contacts extending through the membrane 30 to the top surface of the printhead 10 and thence to other electrodes (not shown) whose voltage may be controlled by circuits wired on the printhead 10 in a manner similar to those used for heater elements 28*a,* 28*b,* as can be appreciated by those skilled in the art of semiconductor manufacture. In this case, the heater electrodes 50*a,* 50*b* are not necessarily used to produce heat nor is heat required for their operation. It is also to be appreciated that the direction of ejection of ink drops 37 according to this embodiment, may be altered so as to compensate for operation-induced misdirection even in cases for which no heaters 28 are present on the top surface, and therefore for printheads 10 which rely on ejection means other than thermal steering.

Figure 5E:
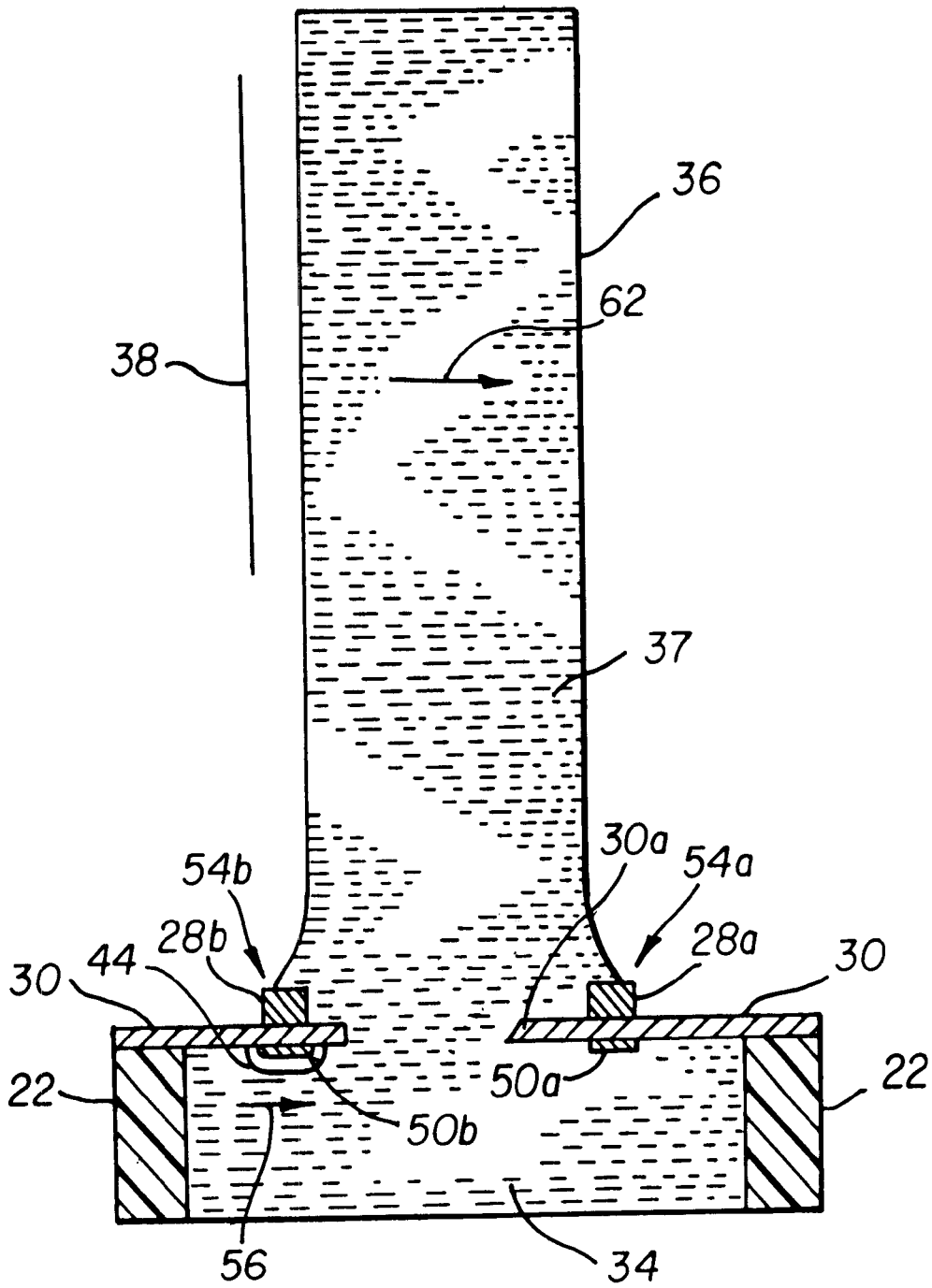
FIG. 5*e* shows the ejection of an ink stream for a corrected nozzle, in accordance with one embodiment of the present invention.

In accordance with the present invention, either of the heater electrodes 50*a,* 50*b* can be coated by electroplating in a manner similar to that described in the first embodiment, in order to compensate for misdirection of ejected ink drops 37 caused by defects, such as defect 30*a*. For example, in FIG. 5*d,* once the nozzle 24 has been tested and identified as needing compensation, the nozzle cavity 32 is filled with an electroplating solution 42 in order to immerse the heater electrodes 50*a,* 50*b* in the electroplating solution 42. In FIGS. 5*d* and 5*e,* an electroplated coating 44 has been added to left heater electrode 50*b* by applying a voltage differential 40 to that electrode 50*b,* resulting in active compensation of the direction of ejected ink drops 37 of ink stream 36 in the direction of first arrow 60 to the left. This compensation is seen by the comparison of the direction of the ink streams 37 in FIGS. 4*b* (misdirected) and 5*e* (compensated). In essence, the additional thickness provided by the electroplated coating 44 in FIGS. 5*d* and 5*e* alters the flow rate of ink 34 on the bottom side of the membrane 30 by reducing the flow rate in ink flow region 56 under heater electrode 50*b* having electroplated coating 44 compared to the flow rate in the region under heater electrode 50*a* having no electroplated coating, thereby altering the balance of forces applied to the ink drops 37 by the ink 34 flowing horizontally near heater electrodes 50*a* and 50*b,* as is predicted by those skilled in fluidic modeling. The same technique could be applied to right heater electrode 50*a* to achieve compensation in an opposite direction.

For example, to compensate for misdirection, as illustrated in FIG. 4*b,* a voltage differential 40 is applied to the heater electrode 50*b,* for example by applying the same voltage 40 to heater 28*b* for the case where heater electrode 50*b* and heater 28*b* are electrically connected, as shown in FIG. 5*d,* in order to create an electroplated coating 44 on heater electrode 50*b*. As a result, the direction at which ink stream 36 exits nozzle opening 26 is altered.

In FIG. 5*d,* an electrical conductor such as Titanium has been formed on the underside of the membrane 30. As before, correction of misaligned ink drop ejection is accomplished, as in the first embodiment, by applying a voltage 40 to at least one electrode 50*a* or 50*b* to form an electroplated coating 44 on that electrode 50*a,* 50*b*. During coating, the nozzle cavity 32 is filled with electroplating solution 42 in order to immerse the heater electrodes 50*a* and 50*b* in electroplating solution 42, but not overfilled so as also to immerse heaters 28*a,* 28*b* in the electroplating solution 42. Specifically, the voltage on the lower left electrode 50*b* causes the electroplating solution 42 to form an electroplated coating 44 about the lower left electrode 50*b* which acts to compensate for a misdirection of ink drops 37 out through the nozzle 24. As before, the electroplated coating 44 may be made thicker or thinner during adjustment by altering the voltage 40, as is well known in the art of electrodeposition/electroetching.

Figure 6A:
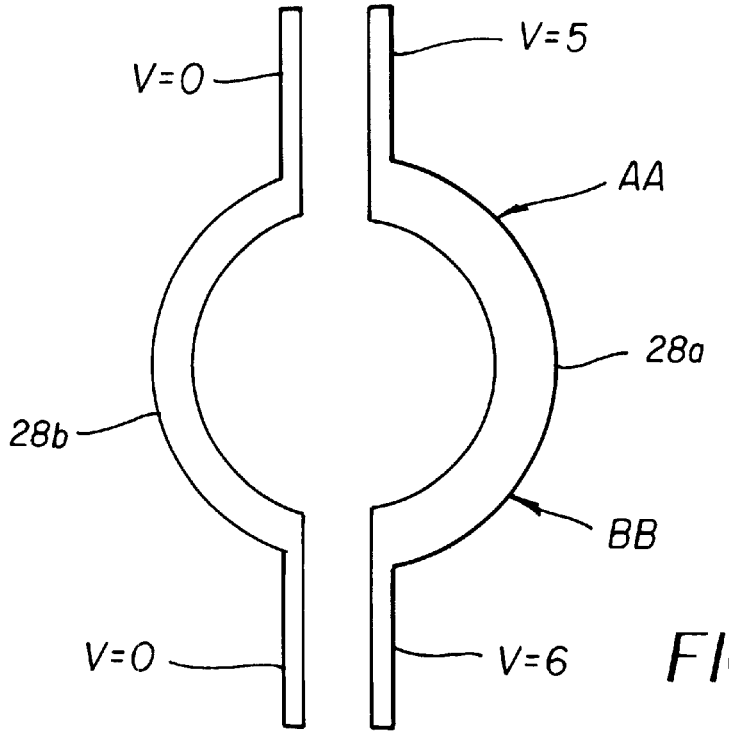
FIGS. 6*a*–6*c* illustrate a method of correcting ink stream misdirection by applying different voltage differentials at the top and bottom of the right heater, in accordance with one embodiment of the present invention.
Figure 6B:
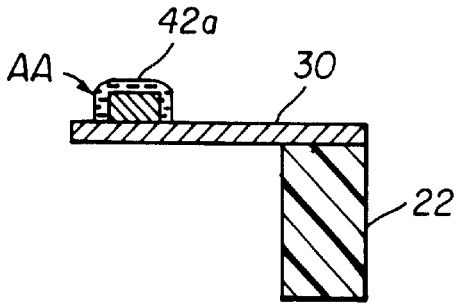
Figure 6C:
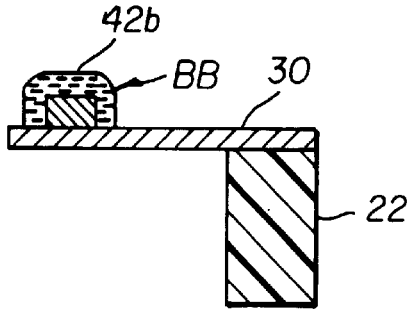

As a final embodiment of the present invention, FIG. 6*a* illustrates a method of achieving correction ink drop misdirection in a direction other than left to right. In this embodiment, the thickness of the electroplated coating across the area spanned by heater 28*a,* for example, varies depending on location along heater 28*a*. Specifically, the thickness of the electroplated coating differs from the top shown portion of heater 28*a* to the bottom shown portion of heater 28*a,* according to the value of applied voltage along the heater 28*a* which here ranges, for example, from 5 volts to 6 volts, respectively, because different voltages are applied to the top and bottom leads of heater 28*a* in FIG. 6*a*. Under the conditions shown in FIG. 6*a,* the voltage is more conducive in region BB to electroplating than in region AA, as can be appreciated by one skilled in the art of electroplating. According to this technique, the ink stream 36 is deflected away from the thickest electroplated coated part 42*b* (FIG. 6*c*) of the heater 28*b* to a greater degree than from the thinnest electroplated coated part 42*a* (FIG. 6*b*) of the heater 28*a,* thereby resulting in a deflection that is not just left or right, but also into and out of the plane. In a related embodiment, the thickness of an electroplated coating 44 formed on one of a pair of electrodes 50*a,* 50*b* on the bottom side of the membrane 30 (FIG. 5*e*) can be made to vary in a way that allows the ink stream 36 to be deflected in directions other than right and left. It is to be appreciated in this case that the direction of ejection of ink drops 37 may be altered so as to compensate for operation induced misdirection even when no heaters are present on the top surface and therefore for printheads which rely on ejection means other than thermal steering.

It should also be understood that a larger number of heater elements or heater electrodes other than two, for example three or four heater elements or heater electrodes, can be employed in other nozzle geometries to allow the formation of an electroplated coating 44 whose thickness varies around the orifice 26, thereby enabling deflection of ink streams 36 in any direction, not just left and right, for the purpose of compensating misdirected nozzles.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

PARTS LIST

10 . . . inkjet printhead
12 . . . mounting block
14 . . . gasket manifold
16 . . . inlet/outlet tubes
18 . . . fluid-flow channels
20 . . . ink reservoir
22 . . . substrate
24 . . . nozzle or nozzles
26 . . . nozzle opening, orifice or bore
28 . . . heater or heaters
28*a* . . . right heater
28*b* . . . left heater
30 . . . membrane
30*a* . . . membrane manufacturing defect or defect
32 . . . nozzle cavity
34 . . . ink
36 . . . ink stream
37 . . . ink drops
38 . . . vertical direction
38*a* . . . angle
40 . . . voltage differential or voltage
42 . . . electroplating solution or plating solution
44 . . . electroplated coating or coating
46 . . . right meniscus
48 . . . left meniscus
50 . . . electrode or electrodes
50*a* . . . right electrode
50*b* . . . left electrode
54 . . . heater element or heater elements
54*a* . . . right heater element
54*b* . . . left heater element
56 . . . ink flow region
60 . . . first arrow
62 . . . second arrow

What is claimed is:

1. For an inkjet printhead having at least one nozzle with heater elements predisposed to direct the flow of ink through the nozzle, a method of compensating for the effects of defects in the printhead to alter the direction of ink drops ejected from the nozzle comprising the steps of:

immersing said heater elements in a plating solution; and causing said plating solution to form a coating about at least one edge of said heater elements which act to compensate for a misdirection of ink drops out through said nozzle.

2. The method according to claim 1 wherein said immersing step is preceded by the step of testing each of said inkjet printheads having at least one nozzle with heater elements for ink stream directionality.

3. The method according to claim 2 wherein said testing step is followed by the step of identifying variability in the direction of the ink drops ejected from a nozzle of said inkjet printhead.

4. The method according to claim 3 wherein said identifying step includes the steps of determining the amount of misdirection for said ink drops ejected from each nozzle and recording the amounts in a look-up table.

5. The method according to claim 1 wherein said step of causing said plating solution to form a coating includes the step of applying a voltage differential to at least one of said heater elements.

6. The method according to claim 5 wherein at least one heater element is a lower heater electrode lying below the top of the nozzle and further including the step of disposing said lower heater electrode in ink.

7. The method according to claim 6 wherein said identifying step is followed by the step of applying a voltage differential to at least one lower heater electrode of said nozzle in order to correct said ink drop misdirection.

8. The method according to claim 7 wherein said applying step further includes the step of changing the voltage to a value for which electroetching occurs.

9. The method according to claim 7 wherein said applying step further includes the step of varying the voltage differential across one of said heater elements in order to establish a varying thickness of coating across the area spanned by said heater element.

10. The method according to claim 1 wherein said causing step further includes the step of varying the time of exposing the heater elements to the plating solution.

11. An inkjet printhead having a plurality of nozzles with at least one nozzle having a heater element compensated for misdirection of ink drops by the method of claim 1.

12. For an inkjet printhead having a plurality of nozzles from which an ink stream flows in order to facilitate printing, a method of correcting defects in the printhead to compensate for the direction of ink stream flow from the printhead comprising the steps of:

determining the amount of unwanted misdirection for ink drops ejected from a printhead; and adding a thickness to one or more heater elements of the printhead, said thickness calculated to compensate for said misdirection.

13. The method according to claim 12 wherein said adding step is preceded by the step of immersing heater elements in an electroplating solution.

14. The method according to claim 12 wherein said adding step further includes the step of causing said electroplating solution to form an electroplated coating about said heater element which acts to compensate for a misdirection of ink stream flow out through at least one of said nozzles.

15. The method according to claim 14 wherein said causing step further includes the step of applying a voltage differential to at least one of said heater elements.

16. The method according to claim 15 wherein said step of applying a voltage differential further includes the step of changing the voltage to a value for which electroetching occurs.

17. The method according to claim 14 wherein at least one of the heater elements is a lower electrode disposed in ink and said causing step is followed by the step of applying a voltage differential to said lower heater electrode of said nozzle in order to deflect the misdirection of said ink stream.

18. The method according to claim 14 wherein said causing step further includes the step of varying the time of electrodeposition.

19. The method according to claim 12 wherein said determining step is preceded by the step of testing each of said inkjet printheads having at least one nozzle with heater elements for ink stream directionality.

20. The method according to claim 19 wherein said testing step is followed by the step of identifying variability in the direction of said ink stream.

21. The method according to claim 12 wherein said determining step further includes the step of identifying the amount of misdirection of said ink drops ejected from a nozzle.

22. The method according to claim 12 wherein said determining step further includes the step of recording the amount of misdirection of said ink drops ejected from a nozzle.

23. An inkjet printhead with integral compensation for misdirection of ink drops ejected through at least one nozzle of the printhead comprising:

a substrate forming a wall which defines a nozzle cavity adapted for facilitating the flow of ink from an ink reservoir;

a membrane predisposed about said nozzle cavity to create a resistive barrier against ink flow, said membrane including a nozzle opening through which ink drops are ejected;

heater elements predisposed to direct the flow of ink through said nozzle opening; and a coating covering one or more heater elements, said coating providing an adjusting effect to compensate for any misdirection in the flow of the ink drops ejected from said nozzle opening.

24. The inkjet printhead according to claim 23 wherein said heater elements further comprise heater electrodes and heaters.

25. The inkjet printhead according to claim 24 wherein said heaters include a right heater and a left heater, said heaters predisposed about said nozzle opening.

26. The inkjet printhead according to claim 24 wherein said heater electrodes further include one or more lower left electrodes and one or more lower right electrodes, said heater electrodes coupled to said heaters and predisposed about said nozzle opening.

27. The inkjet printhead according to claim 24 wherein said heater electrodes and heaters are separated by said membrane.

28. The inkjet printhead according to claim 23 wherein said coating is an electroplated coating and the electroplated coating is chosen from the group consisting of: nickel, copper, aluminum, steel and fluorinated hydrocarbons.

* * * * *